US008776278B1

(12) United States Patent
Dorra

(10) Patent No.: US 8,776,278 B1
(45) Date of Patent: Jul. 15, 2014

(54) AUTO CLEANING TOILET SEAT AND DRYING SYSTEM

(71) Applicant: Maximo Dorra, North Miami Beach, FL (US)

(72) Inventor: Maximo Dorra, North Miami Beach, FL (US)

( * ) Notice: Subject to any disclaimer, the term of this patent is extended or adjusted under 35 U.S.C. 154(b) by 0 days.

(21) Appl. No.: 13/863,601

(22) Filed: Apr. 16, 2013

(51) Int. Cl.
*A47K 13/00* (2006.01)

(52) U.S. Cl.
USPC ..... 4/233

(58) Field of Classification Search
USPC ..... 4/233, 222
See application file for complete search history.

(56) References Cited

U.S. PATENT DOCUMENTS

| | | | | |
|---|---|---|---|---|
| 3,247,524 | A | 4/1966 | Umann | |
| 4,558,473 | A | 12/1985 | Morikawa et al. | |
| 4,628,548 | A | 12/1986 | Kurosawa et al. | |
| 5,319,811 | A | 6/1994 | Hauri | |
| 5,359,736 | A | 11/1994 | Olivier | |
| 6,105,178 | A | 8/2000 | Kurisaki et al. | |
| 6,769,140 | B1 | 8/2004 | Olivier | |
| 7,096,518 | B2 | 8/2006 | Takenaga | |
| 7,155,755 | B2 | 1/2007 | Olivier | |
| 7,191,473 | B2 | 3/2007 | Matsumoto et al. | |
| 7,216,374 | B2 | 5/2007 | Hassan | |
| 8,060,953 | B1 * | 11/2011 | Dorra | 4/233 |
| 8,365,317 | B1 | 2/2013 | Dorra | |
| 2005/0028263 | A1 | 2/2005 | Wodeslavsky | |
| 2005/0246828 | A1 | 11/2005 | Shirai et al. | |
| 2006/0064810 | A1 | 3/2006 | Teranishi et al. | |
| 2009/0133185 | A1 * | 5/2009 | Fisseha | 4/233 |

* cited by examiner

*Primary Examiner* — Huyen Le
(74) *Attorney, Agent, or Firm* — The Concept Law Group, P.A.; Scott D. Smiley; Mark C. Johnson

(57) ABSTRACT

An automatic toilet seat cleaning and drying system having a housing assembly, an electrical system, a liquid matter system, at least one turbine assembly comprising an outlet, and a manifold mounting frame assembly. Extending from the manifold mounting frame assembly is a base assembly. A toilet seat assembly is mounted to the manifold mounting frame assembly. A manifold assembly is mounted to the manifold mounting frame assembly, and a cover assembly is mounted onto the manifold assembly. When the liquid matter system is activated, liquid matter is delivered through nozzle lines and nozzles with a predetermined pressure onto the toilet seat assembly to clean and disinfect. When the at least one turbine assembly is activated, air flowing from the at least one turbine assembly is directed through the manifold assembly with a predetermined pressure to displace, and/or dry the toilet seat assembly.

19 Claims, 10 Drawing Sheets

TIME CHARTS

Cover assembly 320 with manifold assembly 220

Activation of Electro-Magnets 290 and 390

Water and Disinfectant to water line 116 and nozzles 118

Air from air turbines 100 and 200 to manifold assembly 220

AUTO CLEANING TOILET SEAT AND DRYING SYSTEM

BACKGROUND OF THE INVENTION

1. Field of the Invention

The present invention relates to toilet systems, and more particularly, to an automatic toilet seat cleaning and drying system.

2. Description of the Related Art

Applicant believes that one of the closest references corresponds to Applicant's own U.S. Pat. No. 8,060,953 issued on Nov. 22, 2011 for an auto cleaning toilet seat with anal cleaning device and blow dry. However, it differs from the present invention because U.S. Pat. No. 8,060,953 teaches a combined automatic toilet self-cleaning and user hygienic system, comprising a housing assembly, an electrical system, a liquid matter system, a turbine assembly, and a manifold assembly comprising a first at least one cut out. The manifold assembly is partially housed within a manifold. The manifold assembly has ducting for air to flow originating from the turbine assembly. The manifold assembly further comprises a bidet for liquid matter to exit originating from the liquid matter system. A toilet seat assembly has mounting brackets to mount onto the manifold assembly and a cover assembly has a mounting frame to mount onto the manifold assembly. The cover assembly has a second at least one cutout for air to flow originating from the turbine assembly. The cover assembly further has a third at least one cutout for the liquid matter to exit originating from the liquid matter system Applicant believes that another reference corresponds to Applicant's own U.S. Pat. No. 8,365,317 issued on Feb. 15, 2013 for an auto cleaning toilet seat with anal cleaning device and blow dry. However, it differs from the present invention because U.S. Pat. No. 8,365,317 teaches a combined automatic toilet self-cleaning and user hygienic system, having a housing assembly, an electrical system, a liquid matter system, a turbine assembly, and a manifold assembly. The manifold assembly has a first at least one cut out. The manifold assembly is partially housed within a manifold. The manifold assembly has ducting for air to flow originating from the turbine assembly. The manifold assembly further has a bidet for liquid matter to exit from the liquid matter system directed onto a user positioned on a toilet seat assembly. A toilet seat assembly has mounting brackets to mount onto the manifold assembly for rotary movement of the seat assembly. A cover assembly has a mounting frame to mount onto the manifold assembly. The cover assembly further has a rotating arm assembly.

Applicant believes that another reference corresponds to U.S. Patent Application Publication No. 2006/0064810, published on Mar. 30, 2006 to Teranishi, et al. for a human private part washing apparatus. However, it differs from the present invention because Teranishi, et al. teach a human private part washing apparatus that includes a base, a toilet seat supported by the base to pivot, a washing portion provided at the base and capable of washing at least one private part of a person seated on the toilet seat, a microcomputer-based controller provided at the base and incorporating a storage media, in which at least one program can be stored, and a write connector, which includes at least one terminal and a ground terminal and is capable of writing the at least one program at the storage media, and a connector cover configured to detachably cover the write connector; the connector cover being provided with at least one terminating resistance capable of connecting the at least one opened terminal to the ground terminal.

Applicant believes that another reference corresponds to U.S. Patent Application Publication No. 2005/0246828, published on Nov. 10, 2005 to Shirai, et al. for a hygiene washing apparatus. However, it differs from the present invention because Shirai, et al. teach a hygiene washing apparatus that, when the human body is washed, washing water is sprayed on a surface to be washed of the human body from a posterior nozzle and a bidet nozzle. On the other hand, when the human body is not washed, the posterior nozzle and the bidet nozzle are subjected to high-temperature cleaning by a nozzle cleaning nozzle. When it is detected that a sanitary washing apparatus has not been employed yet, the posterior nozzle and the bidet nozzle are allowed to be cleaned by the nozzle cleaning nozzle by a controller. After a cleaning operation is terminated, a user is notified that the cleaning operation is terminated by a notification lamp and a speaker. A scale inhibiting material supply device is interposed in a pipe on the upstream side of an instantaneous heating device by the nozzle cleaning nozzle.

Applicant believes that another reference corresponds to U.S. Patent Application Publication No. 2005/0028263, published on Feb. 10, 2005 to Wodeslaysky for a water and space conservation toilet/bidet combination. However, it differs from the present invention because Wodeslaysky teaches a dual purpose toilet bowl which consists water conservation system which also consists a built in bidet, and this water conservation system is functioning by two stages of the toilet flushing, the first state it is by pressurized water and by gravity simultaneously whereby the gravity tradition flushing method is incorporating a water pressure method being controlled by a proportion valve. The second stage, most of the water will come from the gravity dumping valve. The proportion valve will control the amount of water that will be injected to the toilet bowl relative to the amount of water that will be dumped from the tank by the gravity. The pressurized water is aiming to the bottom of said toilet bowl where the waste is being accumulated whereby the flushing cycle based on water injection into the bottom of said bowl for few seconds in order to create the first push of the waste and simultaneously water dumping until the water will be diverted from the bottom of the toilet to the toilet tank, and said toilet bowl will also consist a bidet apparatus in order to save water on toilet flushing. This bidet apparatus consists safety valves and drainage to ensure that the waste will not go backwards to the fresh water. This bidet nozzle can wash itself and also this nozzle can rinse with soap and also this nozzle can dry the user by warm air.

Applicant believes that another reference corresponds to U.S. Pat. No. 7,216,374 issued to Hassan on May 15, 2007 for a smart toilet seat. However, it differs from the present invention because Hassan teaches a multi-function toilet seat having a body including an oval and arcuate shaped portion, defining an ergonomically configured upper surface and an open interior. A rear portion interconnects opposite extending ends of the arcuate shaped portion. A fluid inlet plug extends from a first location associated with the body and communicates with a plurality of succeeding and interior extending passageway channels. The channels communicate in turn with a plurality of spray nozzles located at spaced locations along an inner defining surface of the seat. A suction outlet extends from a second location associated with the body and communicates with an exhaust motor incorporated into the rear portion. A plurality of exhaust apertures extend along spaced inner locations of the seat and evacuate an airflow from within an associated toilet bowl interior and through the suction outlet.

Applicant believes that another reference corresponds to U.S. Pat. No. 7,191,473 issued to Matsumoto, et al. on Mar. 20, 2007 for a sanitary washing apparatus. However, it differs from the present invention because Matsumoto, et al. teach a sanitary washing apparatus that, when a user sets water power using a water power adjustment switch in a remote control device, a controller controls the period of pressure fluctuations, the width of pressure fluctuations, and the central pressure of the discharge pressure of a pump on the basis of a signal transmitted by radio from the remote control device. When the user sets the divergent angle of washing water using a washing area adjustment switch in the remote control device, the controller controls the divergent angle of the washing water sprayed from a posterior nozzle on the basis of the signal transmitted by radio from the remote control device. Consequently, the washing water supplied to a side surface of a cylindrical swirl chamber from a first flow path in the posterior nozzle is sprayed from a spray hole as dispersed spiral flow, and the washing water supplied to a lower part of the cylindrical swirl chamber from a second flow path in the posterior nozzle is sprayed from the spray hole as linear flow.

Applicant believes that another reference corresponds to U.S. Pat. No. 7,155,755 issued to Olivier on Jan. 2, 2007 for a toilet seat having a cleansing facility. However, it differs from the present invention because Olivier teaches a toilet seat (10) having a cleansing facility with an pivotable arm (18) supplied with warm water for cleaning and warm air for drying the anal and genital areas of a user. The arm (18) being automatically controlled to operate along a path substantially parallel with the central fore and aft axis of the toilet seat (10) between a stored position and an active position. The water is supplied though a duct (36), which has a relatively small cross-sectional area and the air, is supplied through a duct (44) having a relatively large cross-sectional area so as to provide respectively differing volumes of fluid to the user. The water duct (36) and air duct (44) are substantially parallel and both terminate in upward disposition to direct the water and air upwardly onto the user at a close range for efficient cleaning and drying, respectively. The toilet seat (10) has a bi-directional fan (50) that rotates clockwise for delivering air to the anal area of the user and anti-clockwise for delivering air to the genital area of the user. A heater coil (49) is provided in the air duct (44) and optionally upstream of the fan (50). A second water outlet (60) is provided for cleaning male genitals and can be manipulated to adjust its orientation.

Applicant believes that another reference corresponds to U.S. Pat. No. 7,096,518 issued to Takenaga on Aug. 29, 2006 for a body part cleansing unit for toilet. However, it differs from the present invention because Takenaga teaches a body washing unit for a toilet stool, comprising: a case body disposed on the upper surface of a toilet-stool main body, a toilet seat and a toilet-seat cover being connectable to the case body so as to hinge; and a warm-water nozzle incorporated into the case body, wherein cold water in a duct passage for the warm-water nozzle is discharged, before the warm-water nozzle is used.

Applicant believes that another reference corresponds to U.S. Pat. No. 6,769,140 issued to Olivier on Aug. 3, 2004 for a toilet seat having a cleansing facility. However, it differs from the present invention because Olivier teaches a toilet seat (10) having a cleansing facility with an pivotable arm (18) supplied with warm water for cleaning and warm air for drying the anal and genital areas of a user. The arm (18) being automatically controlled to operate along a path substantially parallel with the central fore and aft axis of the toilet seat (10) between a stored position and an active position. The water is supplied though a duct (36), which has a relatively small cross-sectional area and the air, is supplied through a duct (44) having a relatively large cross-sectional area so as to provide respectively differing volumes of fluid to the user. The water duct (36) and air duct (44) are substantially parallel and both terminate in upward disposition to direct the water and air upwardly onto the user at a close range for efficient cleaning and drying, respectively. The toilet seat (10) has a bi-directional fan (50) that rotates clockwise for delivering air to the anal area of the user and anti-clockwise for delivering air to the genital area of the user. A heater coil (49) is provided in the air duct (44) and optionally upstream of the fan (50). A second water outlet (60) is provided for cleaning male genitals and can be manipulated to adjust its orientation.

Applicant believes that another reference corresponds to U.S. Pat. No. 6,105,178 issued to Kurisaki, et al. on Aug. 22, 2000 for a sanitary cleansing apparatus. However, it differs from the present invention because Kurisaki, et al. teach a sanitary cleansing apparatus 20 with attachment state sensor 180 for detecting the state of attachment to toilet bowl 21. When OFF signal is output from attachment state sensor 180, first closing valve 137*a* is closed at step S82 and power supply to cleansing water heater 129 is stopped at step S84; shower nozzle 24 is finally stored in standby position. Therefore, troubles are fairly prevented since shower nozzle 24 is stored in standby position with inhibition of water spouting function when sanitary cleansing apparatus 20 is detached from toilet bowl 21.

Applicant believes that another reference corresponds to U.S. Pat. No. 5,359,736 issued to Olivier on Nov. 1, 1994 for a spray means for a toilet pedestal. However, it differs from the present invention because Olivier teaches a bidet device useable with a toilet has a nozzle (82) which supplies water in an accurate confined spray to the anal or genital area followed by air blown through the same nozzle so as to dry the wetted areas. Both water and air are electrically heated in unit (12) under thermostatic control. A hand grip (60) is used to slide spray conduit (62) and nozzle (82) from a storage position under the lop of the toilet bowl to an appropriate longitudinal position. Switch (52) is then used to control a low voltage circuit, which energizes solenoid valves for the alternate supply of water and air. The unit will not operate unless both microswitch (80) [activated by cam (78)] and a pressure switch responding to the user's weight, are closed. In alternative arrangements the spray assembly is carried on an arm turning on a vertical pivot attached to the toilet pedestal or it forms part of a hand-held wand having no attachment to the toilet pedestal.

Applicant believes that another reference corresponds to U.S. Pat. No. 5,319,811 issued to Haurion on Jun. 14, 1994 for a closet seat for a water closet as well as an apparatus for cleaning the posterior on a water closet having a seat. However, it differs from the present invention because Haurion teaches a water closet that includes a toilet bowl, a toilet seat liftably and lowerably mounted on the toilet bowl, and an apparatus supported adjacent the toilet seat for the personal hygiene of the occupant of the water closet. The apparatus comprises a tank for storing water therein; and an air pump connected with the tank for introducing compressed air into the tank to place a volume thereof under pneumatic pressure. The air pump includes an actuating member for operating the air pump. The apparatus further has a spraying device connected to the tank and supported in a zone of the toilet seat for discharging, from the tank, water driven by the pneumatic pressure to clean the posterior of the occupant. A valve is connected between the tank and the spraying device. The valve has a closed position in which water is prevented from being discharged by the spraying device and an open position in which water is discharged from the spraying device.

Applicant believes that another reference corresponds to U.S. Pat. No. 4,628,548 issued to Kurosawa, et al. on Dec. 16, 1986 for a device and method of moving and controlling the position of a slidable body such as used for body cleansing. However, it differs from the present invention because Kurosawa, et al. teach a device for moving a cleansing nozzle connected to a water supply system that includes an elongated nozzle, a cylinder in which the nozzle is axially slidable, a motor having an output shaft, a drum body mounted on the output shaft, the drum body having a cylindrical rim surface and a sectoral recess extending from the surface, a sectoral insert disposed in the recess and having a partial cylindrical surface conforming to and forming a continuation of the cylindrical rim surface, and a leaf spring having one end connected to the nozzle and the other end held between the drum body and the sectoral insert such that rotation of the drum body extends and withdraws the nozzle longitudinally as the leaf spring unwraps and wraps around the drum body. The method includes counting the number of cycles of the frequency of the electric power supplied to the motor, determining the actual position of the nozzle on the basis of the counted pulses, establishing a predetermined position of the nozzle, comparing the actual position with the predetermined position, and transmitting the results of the comparison to a power circuit for the motor to turn the motor on and off so that the motor thereby positions the slidable nozzle at the predetermined position.

Applicant believes that another reference corresponds to U.S. Pat. No. 4,558,473 issued to Morikawa, et al. on Dec. 17, 1985 for sanitary cleaning equipment. However, it differs from the present invention because Morikawa, et al. teach a sanitary cleaning equipment, which includes a flushing portion adapted to direct a jet of cleaning water against a selected area, a deodorizing portion for withdrawing odoriferous air from the neighborhood of the selected area and deodorizing the same, and a dryer portion adapted to direct a jet of warm air against the area. The above deodorizing portion has a first wind tunnel including a deodorant and the above dryer portion has a second wind tunnel including a heater, the first and second wind tunnels being constructed so that they are selectively communicated with a single fan by switching operation of a damper device, thereby providing a sanitary cleaning equipment which is compact and has a high warm air blowing efficiency and a high deodorization efficiency.

Applicant believes that another reference corresponds to U.S. Pat. No. 3,247,524 issued to Umann, on Apr. 26, 1966 for a hygienic apparatus for use on toilet bowls. However, it differs from the present invention because Umann teaches a hygienic apparatus for use on toilet bowls adapted to be mounted on a toilet bowl in place of the conventional seat, and which is arranged to direct a jet of warm water of small diameter at the anus or adjacent body openings in such a manner that the water is confined essentially to the relatively small region to be cleaned rather than covering large areas of the buttocks. Because the water jet is confined to the region to be cleansed, not only is a minimum volume of warm water required but also a minimum of warm air is required to dry the region, thereby permitting construction of the apparatus in a particularly compact form and minimizing the amount of electrical power required to heat the water and air. Components, such as a water heater, air heater and blower, regulator and shut-off valve, and vacuum relief valve are all contained in a compact housing secured at the rear of the toilet bowl, forwardly of the flush tank; and wherein the toilet seat and cover are hinged or otherwise joined to the housing to form therewith an integral unit, which may be readily attached to the conventional toilet bowl. The hygienic apparatus incorporates means whereby a preliminary supply of water is maintained at essentially body temperature, so that even the initial portion of the water contacting the body does not produce a temperature shock; and is so arranged that a douche attachment may be quickly attached or removed, and which eliminates the need of a long hose line between the hygienic apparatus and the douche tip.

Other patents describing the closest subject matter provide for a number of more or less complicated features that fail to solve the problem in an efficient and economical way. None of these patents suggest the novel features of the present invention.

SUMMARY OF THE INVENTION

The present invention is an automatic toilet seat cleaning and drying system, comprising a housing assembly, an electrical system, a liquid matter system, at least one turbine assembly comprising an outlet, and a manifold mounting frame assembly that mounts onto a toilet. A toilet seat assembly is mounted to the manifold mounting frame assembly. A manifold assembly is mounted to the manifold mounting frame assembly, and a cover assembly is mounted onto the manifold assembly.

The manifold mounting frame assembly comprises at least one inlet mount to receive the outlet. The liquid matter system comprises nozzle lines having nozzles that are mounted onto the manifold assembly. When the liquid matter system is activated, liquid matter is delivered through the nozzle lines and the nozzles onto the toilet seat assembly. When the at least one turbine assembly is activated, air flowing from the at least one turbine assembly is directed through the manifold assembly to displace and/or dry the liquid matter from the toilet seat assembly.

The cover assembly comprises a gasket. In a closed position, the cover assembly covers the toilet seat assembly and forms a seal against the toilet with the gasket.

The manifold assembly comprises a manifold inlet. Extending from the manifold inlet are a manifold top face, lateral walls, and a manifold base plate. Extending from the lateral walls are exterior rear side edges that taper to exterior forward side edges. The exterior forward side edges terminate at respective forward walls, each having a respective cutout. The manifold assembly further comprises an interior rear side edge that also tapers to interior forward side edges. The interior forward side edges also terminate at the forward walls, each having the respective cutout. The manifold assembly further comprises interior duct walls and an interior center wall to direct air flowing from the at least one turbine assembly. The manifold assembly further comprises a manifold bottom face rear section and a manifold bottom face forward section, and mounting holes to receive nozzles.

In an alternative embodiment, extending from the manifold mounting frame assembly is a base assembly that mounts onto the toilet. The base assembly comprises a side edge, an inclined wall, and an interior edge. The inclined wall inclines inwardly from the side edge towards the interior edge. In a closed position, the cover assembly covers the toilet seat assembly and forms a seal against the base assembly with the gasket. The base assembly comprises a first electro-magnet, and the cover assembly comprises second electro-magnet. When activated, the first electro-magnet attracts to the second electro-magnet to keep the cover assembly sealed against the base assembly.

It is therefore one of the main objects of the present invention to provide an automatic toilet seat cleaning and drying system.

It is another object of this invention to provide an automatic toilet seat cleaning and drying system that may be mounted onto any toilet system defined as a fixture that consists usually of a water-flushed bowl and seat and is used for defecation and urination.

It is another object of this invention to provide an automatic toilet seat cleaning and drying system that with a predetermined air and water pressure, washes, disinfects, and dries a toilet seat before use.

It is another object of this invention to provide an automatic toilet seat cleaning and drying system that is volumetrically efficient.

It is another object of this invention to provide an automatic toilet seat cleaning and drying system, which is of a durable and reliable construction.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
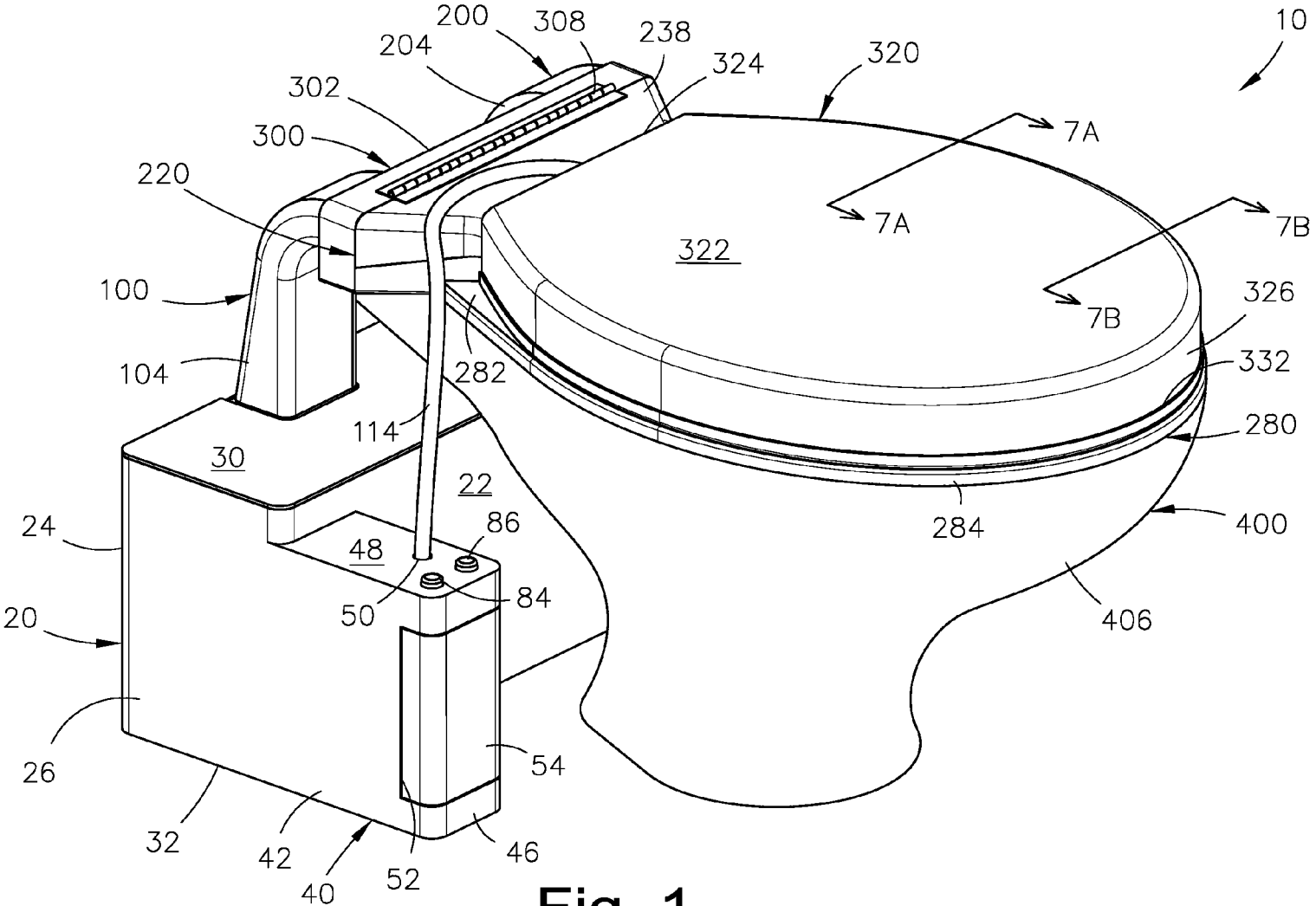
FIG. 1 is an isometric view of the instant invention with its cover assembly in a closed position and installed onto a standard toilet.

Referring now to the drawings, the present invention is an automatic toilet seat cleaning and drying system, and is generally referred to with numeral 10. It can be observed that it basically includes housing assembly 20, electrical system 80, turbine assemblies 100 and 200, liquid matter system 110, manifold assembly 220, toilet seat assembly 270, base assembly 280, manifold mounting frame assembly 300, and cover assembly 320.

As seen in FIG. 1, instant invention 10 is mounted to toilet 400. Toilet 400 is a fixture that usually comprises a water-flushed toilet bowl 406 and rim 402, seen in FIG. 3, and is used for defecation and urination. Although not illustrated, it is noted that toilet 400 may further comprise a tank, and a flushing actuator such as a hand or foot lever, or button.

Figure 2:
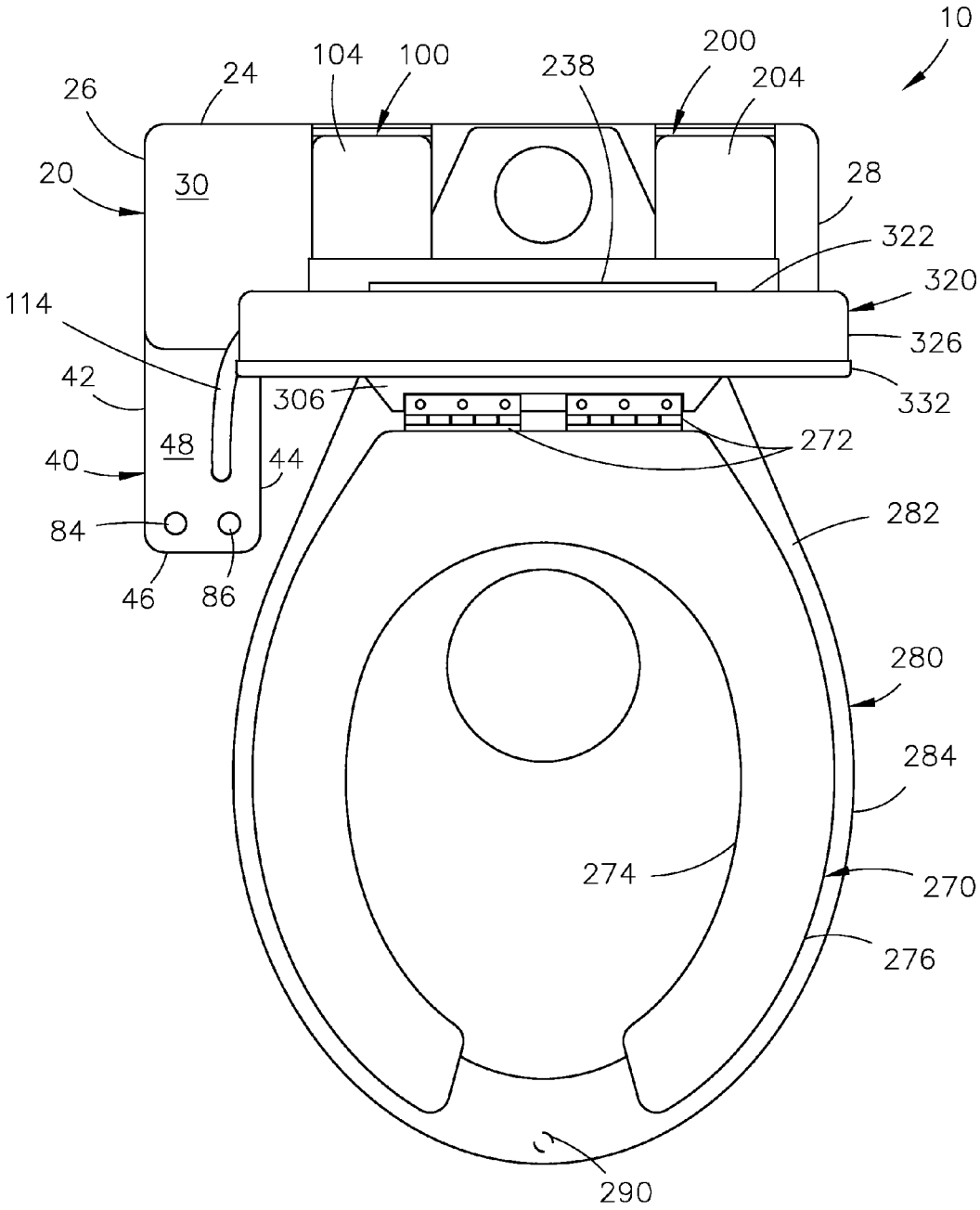
FIG. 2 is a top plan view of the instant invention with its cover assembly in an open position and installed onto the standard toilet.

As seen in FIGS. 1 and 2, housing assembly 20 houses at least one turbine assembly, and in a preferred embodiment, turbine assemblies 100 and 200 that are cooperatively positioned behind toilet 400. Housing assembly 20 comprises front wall 22, rear wall 24, lateral walls 26 and 28, top wall 30, and base 32. Housing assembly 20 also comprises tower assembly 40. Tower assembly 40 comprises lateral walls 42 and 44, front wall 46, top wall 48, hole 50, cutout 52, and front cover panel 54. Turbine assemblies 100 and 200 extend from housing assembly 20 and secure to manifold mounting frame assembly 300. Manifold assembly 220 is hingedly mounted to manifold mounting frame assembly 300 with hinge 308. Extending from manifold mounting frame assembly 300 is base assembly 280 that rests upon toilet 400, specifically rim 402 seen in FIG. 3. In the closed position as illustrated in FIG. 1, cover assembly 320 covers toilet seat assembly 270, seen in FIG. 2, and forms a seal against base assembly 280 with gasket 332.

Figure 3:
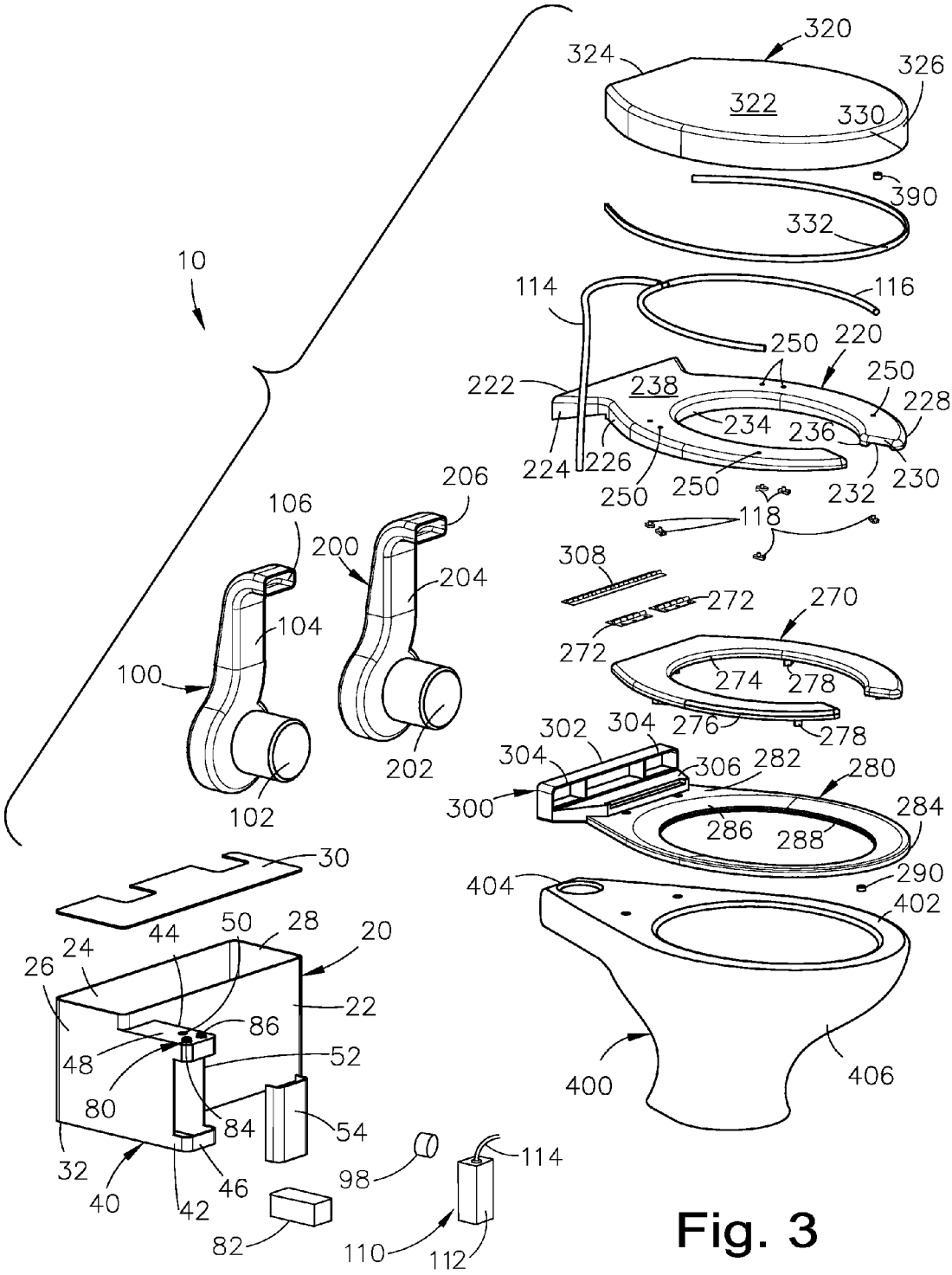
FIG. 3 is an exploded view of the instant invention.
Figure 4:
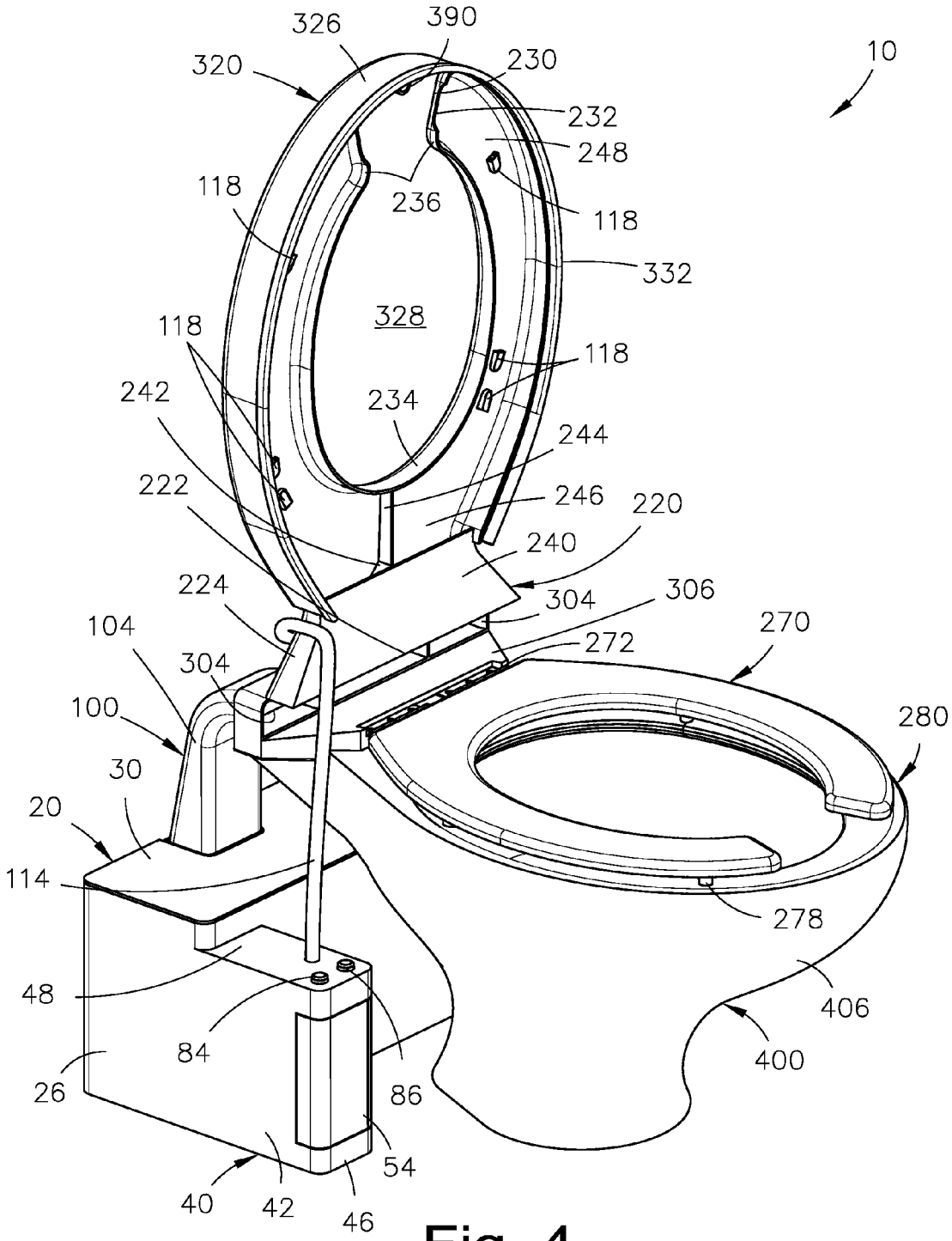
FIG. 4 is an isometric view of the instant invention with its cover assembly in the open position and installed onto the standard toilet.

As seen in FIGS. 3 and 4, front wall 46 of tower assembly 40 has front cover panel 54 removably mounted to cutout 52. Tower assembly 40 and housing assembly 20 house electrical system 80. Electrical system 80 comprises control box 82 with switches 84 and 86. Electrical system 80 further comprises electrical wiring 94, seen in FIG. 9. Also housed in tower assembly 40 are impeller pump 98, and disinfectant container 112 of liquid matter system 110. Regulator valve 90 regulates amounts of disinfectant utilized that is contained in disinfectant container 112. Extending from disinfectant container 112, and passing through hole 50, is connecting line 114 that extends to nozzle lines 116.

Turbine assembly 100 is housed within housing assembly 20 and comprises housing 102, duct 104 and outlet 106. Turbine assembly 100 may comprise a heating element, not seen, to produce warm/hot air. Turbine assembly 100 produces air pressure to enable washing, disinfecting, and drying of toilet seat assembly 270 before use. A respective inlet mount 304 of frame 302 is of a cooperative shape and dimension to snugly receive outlet 106 at the distal end of duct 104. Similarly, turbine assembly 200 is housed within housing assembly 20 and comprises housing 202, duct 204 and outlet 206. Turbine assembly 200 may comprise a heating element, not seen, to produce warm/hot air. Turbine assembly 200 produces air pressure to enable washing, disinfecting, and drying of toilet seat assembly 270 before use. A respective inlet mount 304 of frame 302 is of a cooperative shape and dimension to snugly receive outlet 206 at the distal end of duct 204.

Extending from manifold mounting frame assembly 300 is base 306. Extending from manifold mounting frame assembly 300, and more specifically from base 306, is base assembly 280 that rests upon rim 402. Base assembly 280 comprises top wall 282, side edge 284, inclined wall 286, interior edge 288, and electro-magnet 290. It is noted that inclined wall 286 inclines inwardly towards interior edge 288 so that any liquid matter, and specifically from liquid matter system 110, will by gravity drain into toilet bowl 406. Such liquid matter may be, but is not limited too, water, water combined with other matter such as a chemical, a chemical solution, and/or a chemical solution comprising a disinfectant contained in disinfectant container 112 as an example.

Positioned onto base assembly 280 is toilet seat assembly 270. Toilet seat assembly 270 comprises mounting brackets 272, inner edge 274, outer edge 276, and bumpers 278. It is noted that toilet seat assembly 270 is mounted to base 306 with mounting brackets 272 as seen in FIG. 4.

Figure 5A:
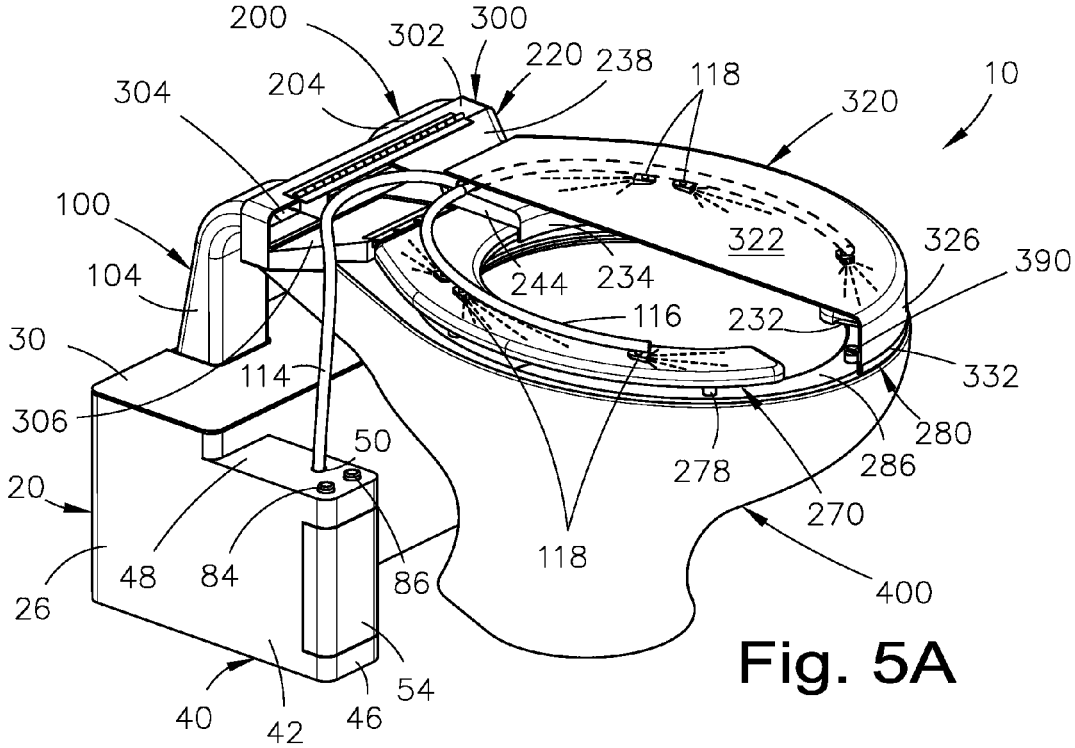
FIG. 5A is a partially sectioned isometric view of the cover assembly in the closed position and showing an activated water system.
Figure 5B:
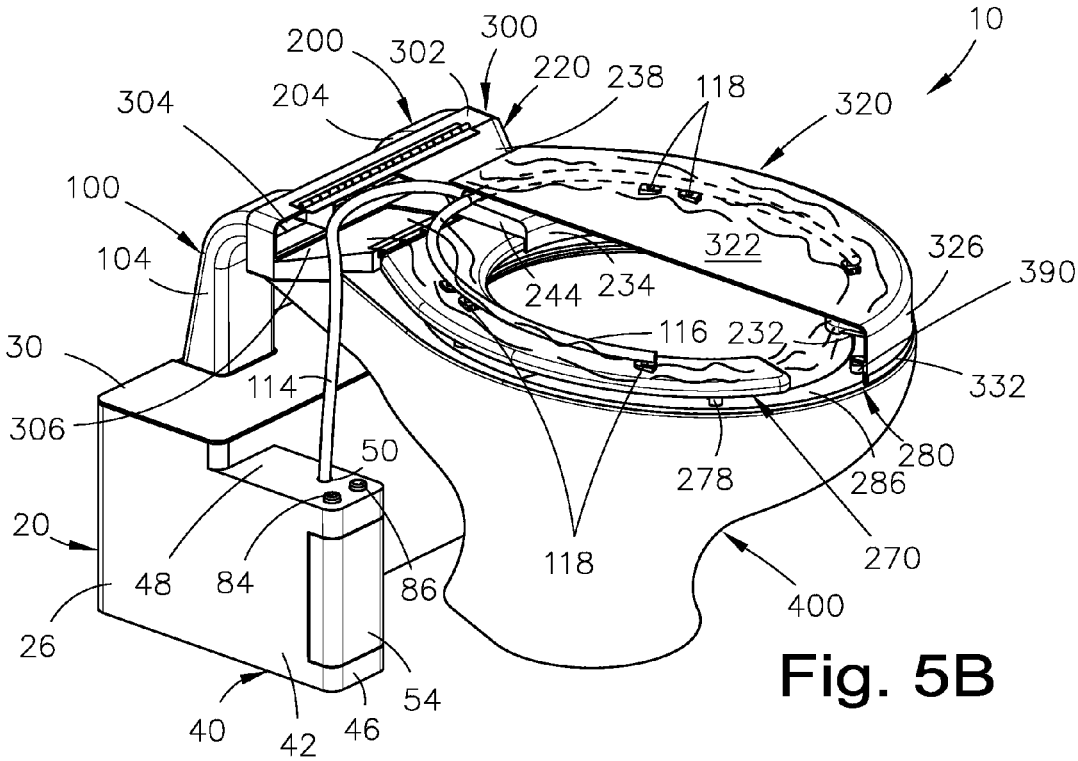
FIG. 5B is a partially sectioned isometric view of the cover assembly in the closed position and showing activated turbine assemblies.

Positioned onto toilet seat assembly 270 is manifold assembly 220. Manifold assembly 220 comprises manifold inlet 222, and extending from manifold inlet 222 are manifold top face 238, lateral walls 224, and manifold base plate 240. Important to note that extending from lateral walls 224 are exterior rear side edges 226 that taper to exterior forward side edges 228 and terminate at forward wall 230 having respective cutout 232. Manifold assembly 220 also comprises interior rear side edge 234 that also tapers to interior forward side edges 236 and also terminate at forward wall 230 having respective cutout 232. Manifold assembly 220 further comprises mounting holes 250 to receive nozzles 118. It is noted that manifold assembly 220 is hingedly mounted to frame 302 with hinge 308 as seen in FIGS. 5A and 5B. In an alternate embodiment, nozzles 118 may be mounted onto manifold mounting frame assembly 300, and specifically inlet mounts 304; or internally at a predetermined distance from manifold inlet 222 of manifold assembly 220.

Mounted onto manifold assembly 220 is cover assembly 320. Cover assembly 320 comprises top wall 322, end 324, sidewall 326, bottom face 328, edge 330, gasket 332, and electro-magnet 390. It is noted that gasket 332 mounts onto edge 330.

As seen in FIG. 5A, cover assembly 320 in the closed position has been partially cross-sectioned to show the activated water system. In operation, instant invention 10 is activated with switch 84, whereby liquid matter system 110 having liquid matter is delivered through connecting line 114, nozzle lines 116, and nozzles 118 for a predetermined period of time onto toilet seat assembly 270. From toilet seat assembly 270, the liquid matter drains into toilet bowl 406. Any liquid matter landing on inclined wall 286 will by gravity also drain into toilet bowl 406. It is noted that in the illustrated position, cover assembly 320 covers toilet seat assembly 270 and forms a seal against base assembly 280 with gasket 332. In a preferred embodiment, cover assembly 320, connecting line 114, nozzle lines 116, manifold assembly 220, and nozzles 118 are made of a transparent material for a user to be able to view instant invention in operation. Instant invention 10 may further comprise a proximity sensor to cause cover assembly 320 to close and activate water system.

As seen in FIG. 5B, cover assembly 320 in the closed position has been partially cross-sectioned to show the activated turbine assemblies. In operation, a displacing and drying cycle starts. Air flowing from turbine assemblies 100 and 200, causing air pressure, is directed through manifold assembly 220 that is positioned onto toilet seat assembly 270. The tapering from exterior rear side edges 226 to exterior forward side edges 228, and from interior rear side edge 234 to interior forward side edges 236, causes an increase in air pressure to displace and/or dry the liquid matter from toilet seat assembly 270. In a preferred embodiment, the air primarily flows out from cutouts 232. It is noted that in the illustrated position, cover assembly 320 covers toilet seat assembly 270 and forms a seal against base assembly 280 with gasket 332. Instant invention 10 is then clean, sanitized, and ready for use by a user. The proximity sensor, when activated, may also cause cover assembly 320 to open once this cycle is completed.

Figure 6:
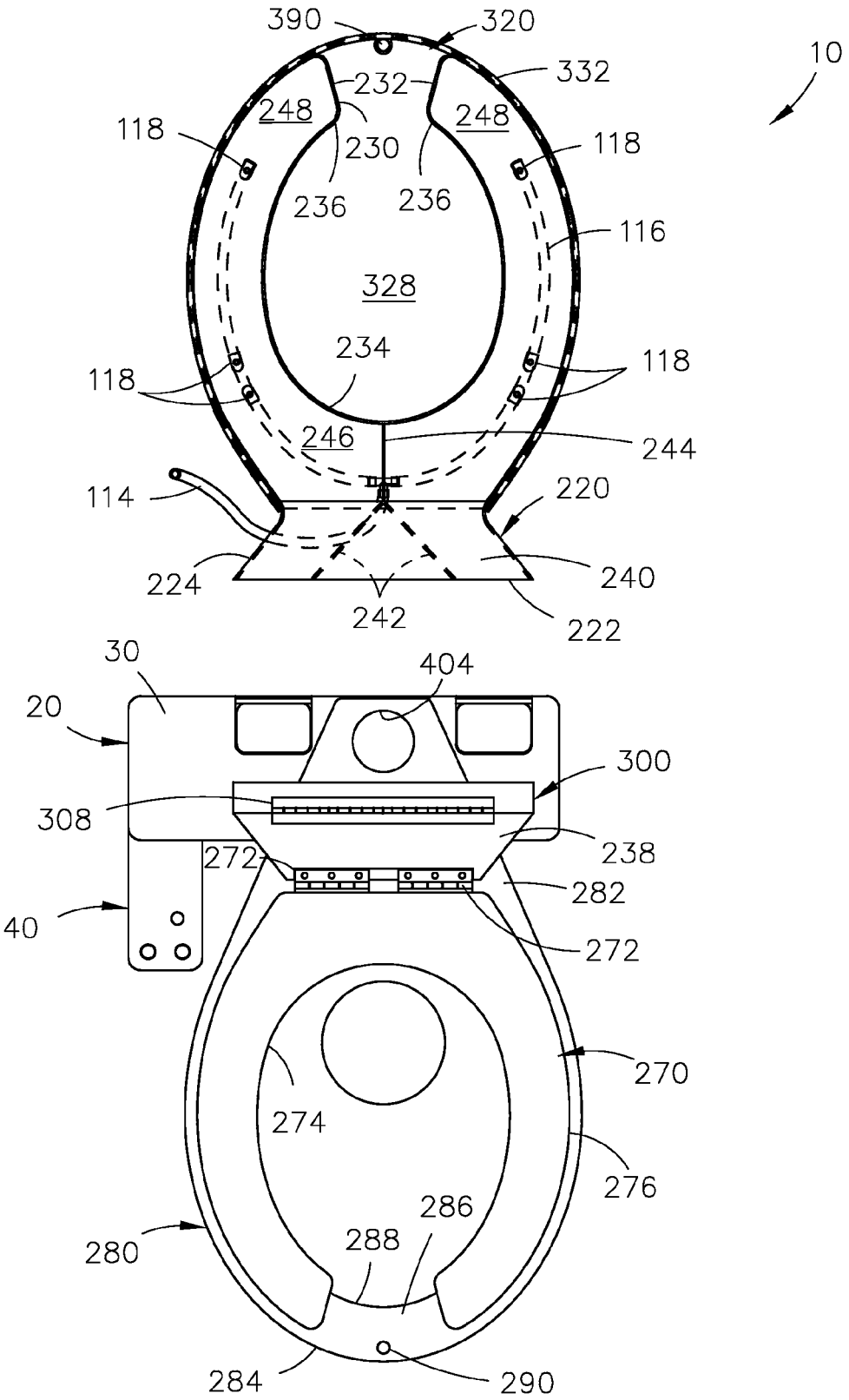
FIG. 6 is a top plan view of the instant invention installed onto the standard toilet, wherein its cover assembly has been removed and is seen from a bottom side.

As seen in FIG. 6, base assembly 280 comprises electro-magnet 290, and cover assembly 320 comprises electro-magnet 390. During the activated water system and activated turbine assemblies cycles defined above, electro-magnet 290 is activated to attract to electro-magnet 390 to keep cover assembly 320 sealed against base assembly 280 with gasket 332.

Figure 7A:
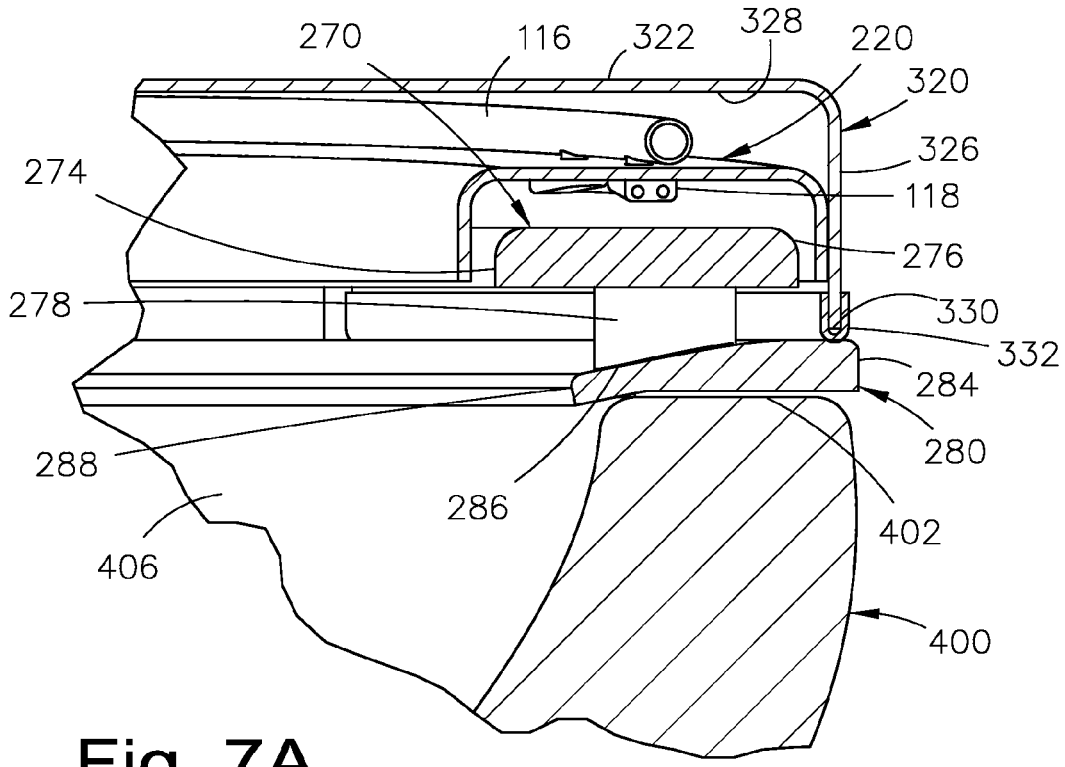
FIG. 7A is a cross section view taken along lines 7A-7A from FIG. 1.
Figure 7B:
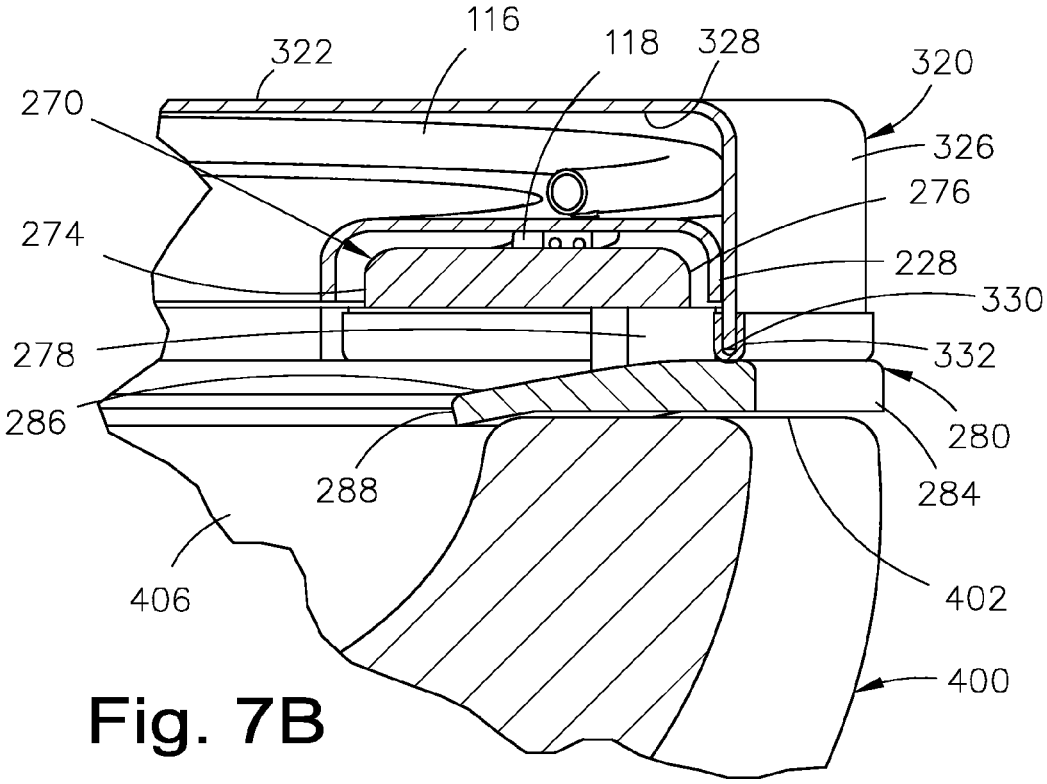
FIG. 7B is a cross section view taken along lines 7B-7B from FIG. 1.

As seen in FIGS. 7A and 7B, base assembly 280 rests upon rim 402. Inclined wall 286 inclines inwardly towards interior edge 288 so that any liquid matter, and specifically from liquid matter system 110, will by gravity drain into toilet bowl 406 of toilet 400. Positioned onto base assembly 280 is toilet seat assembly 270 having bumpers 278. In a preferred embodiment, bumpers 278 may be shaped to complement an angle of inclined wall 286. Positioned onto toilet seat assembly 270 is manifold assembly 220. Mounted onto manifold assembly 220 is cover assembly 320. Gasket 332 mounts onto edge 330 to form a seal when cover assembly 320 is biased against base assembly 280.

Figure 8A:
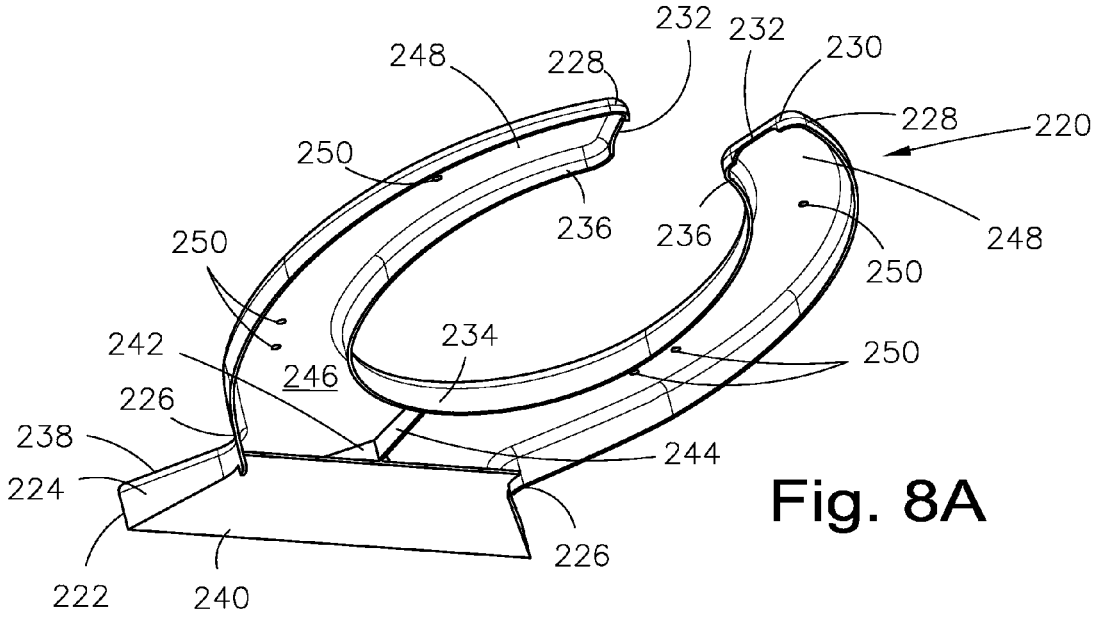
FIG. 8A is an isometric bottom view of a manifold assembly.
Figure 8B:
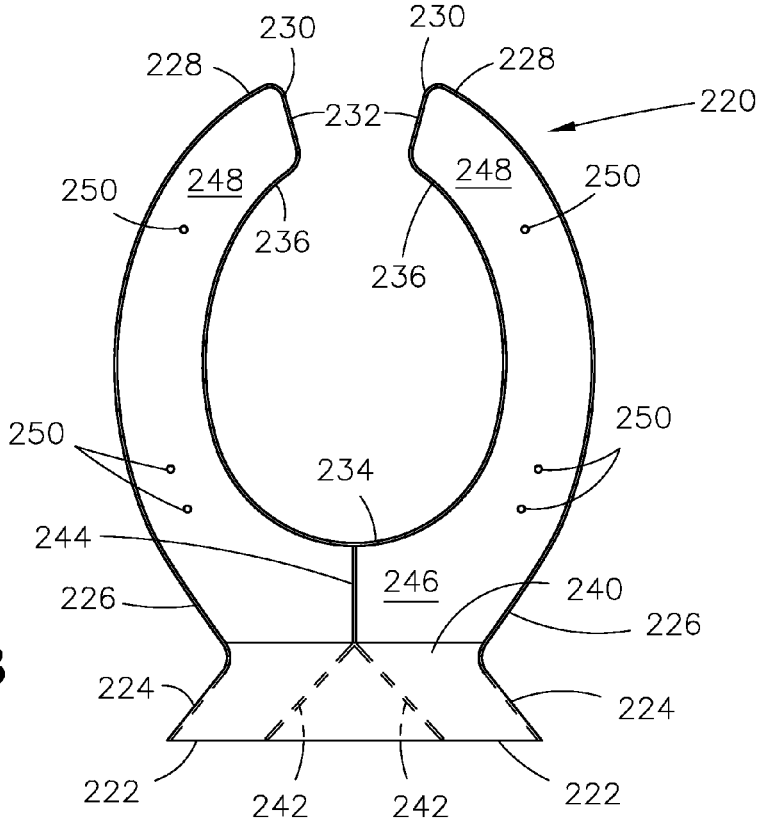
FIG. 8B is a bottom view of the manifold assembly.

As best seen in FIGS. 8A and 8B, manifold assembly 220 comprises manifold inlet 222, and extending from manifold inlet 222 are manifold top face 238, lateral walls 224, and manifold base plate 240. Important to note that extending from lateral walls 224 are exterior rear side edges 226 that taper to exterior forward side edges 228 and terminate at forward wall 230 having respective cutout 232. Manifold assembly 220 also comprises interior rear side edge 234 that also tapers to interior forward side edges 236 and also terminate at forward wall 230 having respective cutout 232. Manifold assembly 220 further comprises mounting holes 250 to receive nozzles 118. Manifold assembly 220 further comprises interior duct walls 242 and interior center wall 244 that serve to direct air flowing from turbine assemblies 100 and 200. Manifold assembly 220 further comprises manifold bottom face rear section 246 and manifold bottom face forward section 248.

Figure 9:
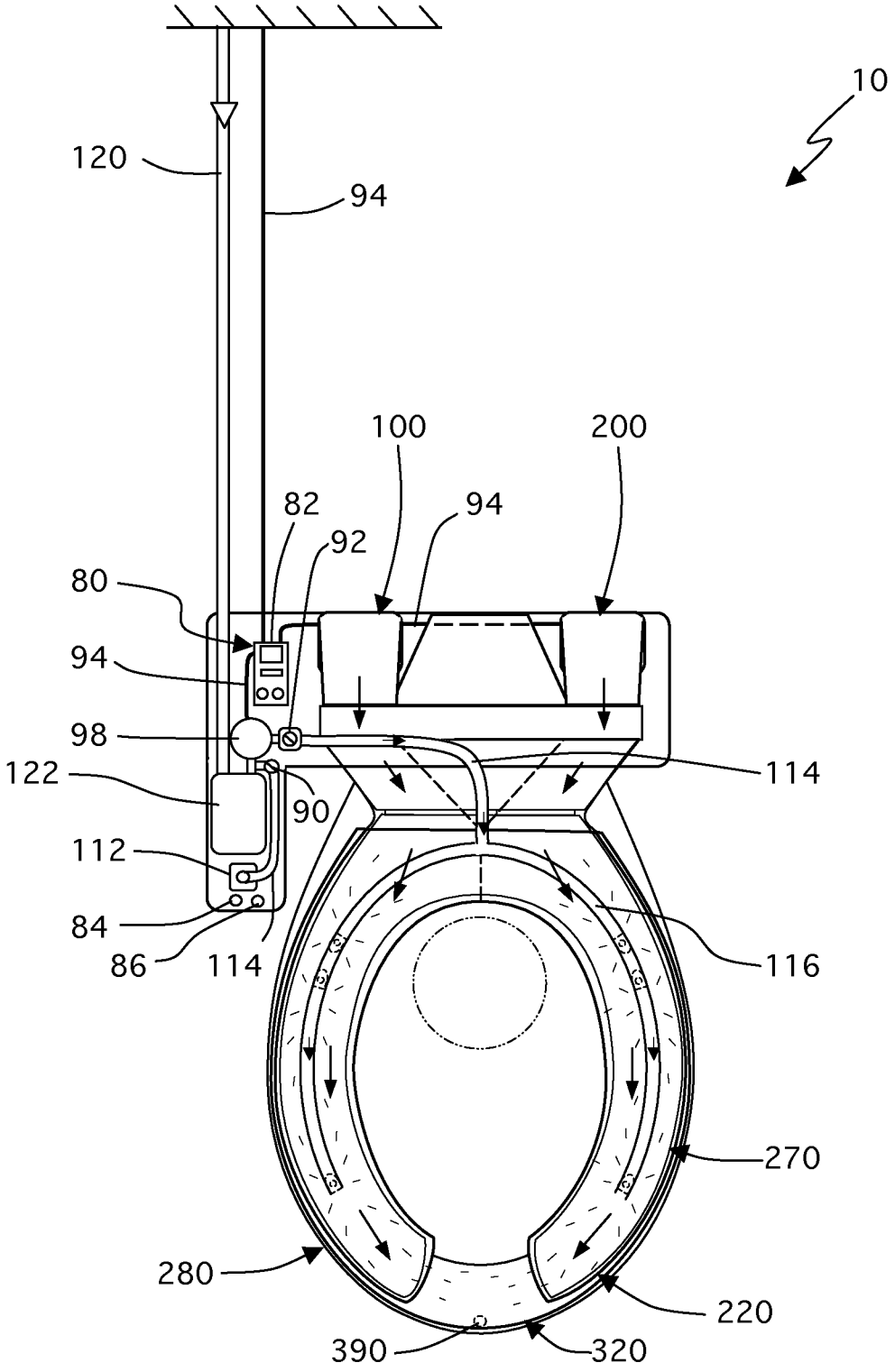
FIG. 9 is a schematic diagram of the instant invention.

Seen in FIG. 9 is a schematic diagram of the connections for instant invention 10. Water enters from a water source through plumbing line 120 and flows to water reservoir 122. In an alternate embodiment, water entering from the water source through plumbing line 120 may also bypass water reservoir 122. In a preferred embodiment, plumbing line 120 from the water source transports water to instant invention 10. From water reservoir 122, water flows to impeller pump 98. Pressure regulator 92 regulates water pressure from water reservoir 122 through connecting line 114, nozzle lines 116, and nozzles 118.

Air flowing from turbine assemblies 100 and 200, causing air pressure, is directed through manifold assembly 220 that is positioned onto toilet seat assembly 270. The tapering from exterior rear side edges 226 to exterior forward side edges 228, and from interior rear side edge 234 to interior forward side edges 236, causes an increase in air pressure to displace and/or dry the liquid matter from toilet seat assembly 270.

From a power source, not seen, electrical wiring 94 supplies electrical power to control box 82, switches 84 and 86, and turbine assemblies 100 and 200. Instant invention 10 is deactivated with switch 86.

Figure 10A:
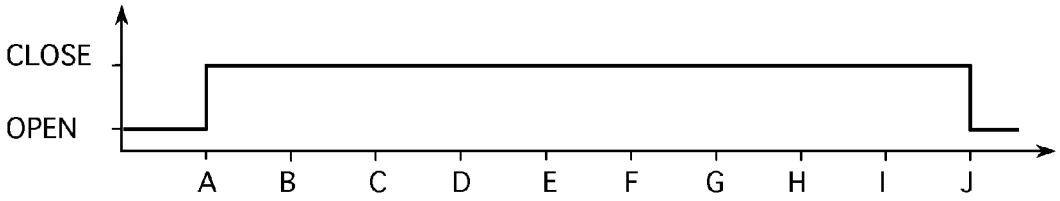
FIGS. 10A, 10B, 10C, and 10D are timing charts of the instant invention.

FIGS. 10A, 10B, 10C, and 10D represent timing charts showing different dispositions and states of the components of instant invention 10 in a period of time as follows:

Seen in FIG. 10A, period of time A-J: cover assembly 320 is in a closed position.

Figure 10B:
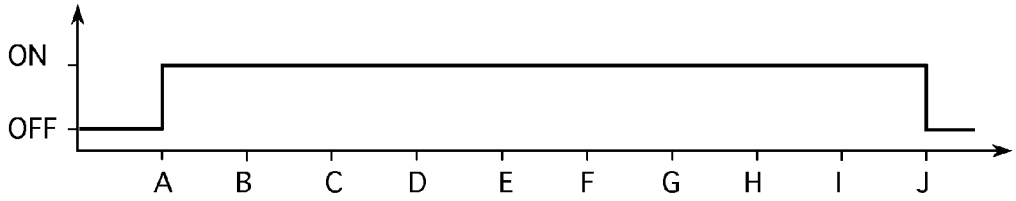

Seen in FIG. 10B, period of time A-J: electro-magnet 290 is activated to attract to electro-magnet 390 to keep cover assembly 320 sealed against base assembly 280.

Figure 10C:
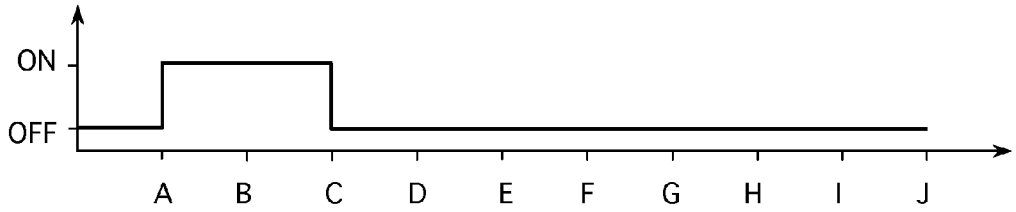

Seen in FIG. 10C, period of time A-C: liquid matter system 110 is activated with switch 84, whereby liquid matter is delivered through connecting line 114, nozzle lines 116, and nozzles 118 onto toilet seat assembly 270.

Figure 10D:
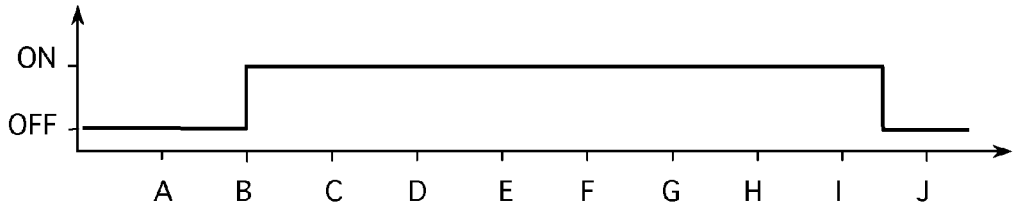

Seen in FIG. 10D, period of time B-between I and J: air flowing from turbine assemblies 100 and 200, causing air pressure, is directed through manifold assembly 220 to displace and/or dry the liquid matter from toilet seat assembly 270. Instant invention 10 is then clean, sanitized, and ready for use by a user.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. An automatic toilet seat cleaning and drying system, comprising:

A) a housing assembly;

B) an electrical system;

C) a liquid mater system;

D) at least one turbine assembly comprising an outlet;

E) a manifold mounting frame assembly that mounts onto a toilet;

F) a toilet seat assembly mounted to said manifold mounting frame assembly;

G) a manifold assembly;

mounted to said manifold mounting frame assembly; and having a manifold inlet with a manifold top face, lateral walls, and a manifold base plate extending from the manifold inlet, the lateral walls including exterior rear side edges that extend from the lateral walls and taper to exterior forward side edges; and H) a cover assembly mounted onto said manifold assembly.

2. The automatic toilet seat cleaning and drying system set forth in claim 1, further characterized in that said manifold mounting frame assembly comprises at least one inlet mount to receive said outlet.

3. The automatic toilet seat cleaning and drying system set forth in claim 1, further characterized in that said liquid matter system comprises nozzle lines having nozzles that are mounted onto said manifold assembly.

4. The automatic toilet seat cleaning and drying system set forth in claim 3, further characterized in that when said liquid matter system is activated, liquid matter is delivered through said nozzle lines and said nozzles onto said toilet seat assembly.

5. The automatic toilet seat cleaning and drying system set forth in claim 4, further characterized in that when said at least one turbine assembly is activated, air flowing from said at least one turbine assembly is directed through said manifold assembly to displace and/or dry said liquid matter from said toilet seat assembly.

6. The automatic toilet seat cleaning and drying system set forth in claim 1, further characterized in that said cover assembly comprises a gasket.

7. The automatic toilet seat cleaning and drying system set forth in claim 6, further characterized in that in a closed position said cover assembly covers said toilet seat assembly and forms a seal against said toilet with said gasket.

8. The automatic toilet seat cleaning and drying system set forth in claim 6, further characterized in that extending from said manifold mounting frame assembly is a base assembly that mounts onto said toilet.

9. The automatic toilet seat cleaning and drying system set forth in claim 8, further characterized in that said base assembly comprises a side edge, an inclined wall, and an interior edge, said inclined wall inclines inwardly from said side edge towards said interior edge.

10. The automatic toilet seat cleaning and drying system set forth in claim 9, further characterized in that in a closed position said cover assembly covers said toilet seat assembly and forms a seal against said base assembly with said gasket.

11. The automatic toilet seat cleaning and drying system set forth in claim 1, further characterized in that said exterior forward side edges terminate at respective forward walls, each having a respective cutout.

12. The automatic toilet seat cleaning and drying system set forth in claim 11, further characterized in that said manifold assembly further comprises an interior rear side edge that also tapers to interior forward side edges.

13. The automatic toilet seat cleaning and drying system set forth in claim 12, further characterized in that said interior forward side edges also terminate at said forward walls, each having said respective cutout.

14. The automatic toilet seat cleaning and drying system set forth in claim 1, further characterized in that said manifold assembly further comprises interior duct walls and an interior center wall to direct air flowing from said at least one turbine assembly.

15. The automatic toilet seat cleaning and drying system set forth in claim 1, further characterized in that said manifold assembly further comprises a manifold bottom face rear section and a manifold bottom face forward section.

16. The automatic toilet seat cleaning and drying system set forth in claim 1, further characterized in that said manifold assembly comprises mounting holes to receive nozzles.

17. The automatic toilet seat cleaning and drying system set forth in claim 1, further characterized in that said base assembly comprises a first electro-magnet, and said cover assembly comprises second electro-magnet, when activated, said first electro-magnet attracts to said second electro-magnet to keep said cover assembly sealed against said base assembly.

18. An automatic toilet seat cleaning and drying system, comprising:

A) a housing assembly;

B) an electrical system;

C) a liquid mater system;

D) at least one turbine assembly comprising an outlet;

E) a manifold mounting frame assembly with a base assembly extending therefrom that mounts onto a toilet, the base assembly having a side edge, an inclined wall, and an interior edge, the interior edge inclining inwardly from said side edge towards said interior edge;

F) a toilet seat assembly mounted to said manifold mounting frame assembly;

G) a manifold assembly mounted to said manifold mounting frame assembly; and

H) a cover assembly mounted onto said manifold assembly, wherein the cover assembly covers said toilet seat assembly and forms a seal against said base assembly with a gasket when in a closed position.

19. An automatic toilet seat cleaning and drying system, comprising:

A) a housing assembly;

B) an electrical system;

C) a liquid mater system;

D) at least one turbine assembly comprising an outlet;

E) a manifold mounting frame assembly with a base assembly coupled thereto that mounts onto a toilet, the base assembly including a first electro-magnet;

F) a toilet seat assembly mounted to said manifold mounting frame assembly;

G) a manifold assembly mounted to said manifold mounting frame assembly; and

H) a cover assembly mounted onto said manifold assembly, the cover assembly including a second electro-magnet and, when activated, the first electro-magnet attracts to the second electro-magnet to keep the cover assembly sealed against the base assembly.

* * * * *